US006374557B1

(12) United States Patent
O'Donnell

(10) Patent No.: US 6,374,557 B1
(45) Date of Patent: Apr. 23, 2002

(54) WEEP HOLE CONSTRUCTION

(75) Inventor: Richard H. O'Donnell, Palgrave (CA)

(73) Assignee: Ashland Products, Inc., Lowell, IN (US)

( * ) Notice: Subject to any disclaimer, the term of this patent is extended or adjusted under 35 U.S.C. 154(b) by 0 days.

(21) Appl. No.: 09/608,626

(22) Filed: Jun. 30, 2000

(51) Int. Cl.[7] ..... E06B 7/14
(52) U.S. Cl. ..... 52/209; 49/408; 160/44
(58) Field of Search ..... 52/209, 204.52; 49/408, 406, 504; 160/44

(56) References Cited

U.S. PATENT DOCUMENTS

| | | | | |
|---|---|---|---|---|
| 1,919,367 A | | 7/1933 | Hamm et al. | |
| 3,184,801 A | * | 5/1965 | Fletcher | 52/209 |
| 3,314,201 A | | 4/1967 | Riegelman | |
| 3,410,027 A | * | 11/1968 | Bates | 52/209 X |
| 3,503,169 A | * | 3/1970 | Johnson et al. | 52/209 |
| 3,555,736 A | | 1/1971 | Koch, Jr. et al. | |
| 4,003,171 A | * | 1/1977 | Mitchell | 52/209 |
| 4,112,645 A | | 9/1978 | Greenfield | |
| 4,512,125 A | | 4/1985 | Eriksson et al. | |
| 4,691,487 A | | 9/1987 | Kessler | |
| 5,044,121 A | | 9/1991 | Harbom et al. | |
| 5,123,212 A | * | 6/1992 | Dallaire et al. | 52/209 |
| 5,822,934 A | | 10/1998 | O'Donnell | |
| 6,098,355 A | * | 8/2000 | Li | 52/209 X |

FOREIGN PATENT DOCUMENTS

| | | |
|---|---|---|
| CA | 2131958 | 3/1996 |

* cited by examiner

*Primary Examiner*—David M. Purol
(74) *Attorney, Agent, or Firm*—Wallenstein & Wagner, Ltd.

(57) ABSTRACT

A window unit (14) has an extruded frame (12) and a moveable window panel (4). The frame (12) has a channel (24) for mounting the window panel therein and a cavity (36) disposed outwardly of the channel (24). The frame (12) further has first and second throughbores (60, 69) for facilitating communication between the channel and the cavity, wherein the first throughbore (60) is disposed at a level below the second throughbore (69). A third throughbore (64) is provided for facilitating communication between the cavity (36) and an external environment. A first weeper (8) is mounted in the first throughbore (60), including a flapper valve (62) characterized by open and closed positions, wherein the flapper valve (62) assumes the open position upon urging by fluid pressure in the channel (24). The frame (12) may also include a second weeper (10) mounted in the third throughbore (64) wherein the first and second weepers (8, 10) can be configured to be an internal weeper (8) or an external weeper (10).

12 Claims, 3 Drawing Sheets

WEEP HOLE CONSTRUCTION

FIELD OF THE INVENTION

This invention relates to a window or door drain and, more particularly, relates to a water drain or weep hole at the base of an extruded window or door sash or frame.

BACKGROUND OF THE INVENTION

Frames used for mounting sliding or rolling vent panels in windows or doors are commonly made of extruded plastic or metal alloy members. The window frame is formed with channels having vertical walls or flanges to accommodate and mount both the sliding or rolling panel and the fixed panel. Such construction is susceptible to moisture ingress, resulting in the collection of water in the channels of the sash. To drain the collected water, weep holes are provided in the flanges or the walls of the channels in the sash.

During storms, winds of high velocity cause a zone of high air pressure on and adjacent the walls of buildings, relative to the air pressure within the buildings and relative to the air pressure within the sashes of windows located on said walls, particularly if said windows are snugly mounted. The interiors of the window frames, such as extruded plastic or metal window frames, are essentially hollow and contain recesses in which single, double and triple-glazed window panes are mounted by means of continuous resilient flanges. The high exterior air pressure thus in effect generates a partial vacuum within the window frames which sucks up water as it flows down and across the exterior faces of the windows during storms to accumulate within the window frames.

U.S. Pat. No. 3,314,201 discloses a construction comprising inner and outer channels, characterized by an inside and outside flange, and a common flange between the two channels. A weep hole is provided in the common flange to drain the inner channel into the outer channel and then out through a weep hole provided in the outside flange. The weep hole in the common flange includes a flapper valve for preventing inward flow of dirt or moisture into the inner channel. Unfortunately, where a partial vacuum is generated in the window, as above described, the flapper valve may close, preventing escape of collected liquid in the inner channel.

SUMMARY OF THE INVENTION

In one broad aspect the present invention provides a window unit including an extruded frame and a moveable window panel, the frame comprising a channel for mounting the window panel therein, a cavity disposed outwardly of the channel, first and second throughbores for facilitating communication between the channel and the cavity, wherein the first throughbore is disposed at a level below the second throughbore, a third throughbore for facilitating communication between the cavity and an external environment, and a first weeper, mounted in the first throughbore, including a flapper valve characterized by open and closed positions, wherein the flapper valve assumes the open position upon urging by fluid pressure in the channel. The window unit can further include a second weeper, mounted in the third throughbore, including a flapper valve characterized by open and closed positions, wherein the flapper valves assumes the open position open urging by fluid pressure in the cavity.

In another aspect the present invention provides a water drain unit for insertion in a mating wall slot in a window unit, comprising a frame, a first and a second set of mating holes formed in the frame, a first seating surface including a first orifice, and a second seating surface including a second orifice, wherein the first and second seating surfaces are mounted in the frame and wherein the first and second orifices are in communication, and a flapper valve mounted within either of the first or second set of mating holes for seating against the first seating surface when mounted in the first set of mating holes and for seating against the second seating surface when mounted in the second set of mating holes. The frame can further comprise a peripheral flange disposed at a first end for abutment against the wall of a window unit, and defining a drain opening, a deep upper wall with a plurality of upstanding ribs extending therefrom for frictional engagement with the wall slot, a shallow lower wall with a plurality of pliable ribs depending therefrom for frictional engagement with the wall slot, and first and second sidewalls extending between and joining the upper and lower walls, each of the sidewalls terminating and merging with a second end of the frame to define a second open end.

BRIEF DESCRIPTION OF THE DRAWINGS

The weep hole construction of the invention will now be described in detail with reference to the accompanying drawings, in which.

DETAILED DESCRIPTION

Figure 1:
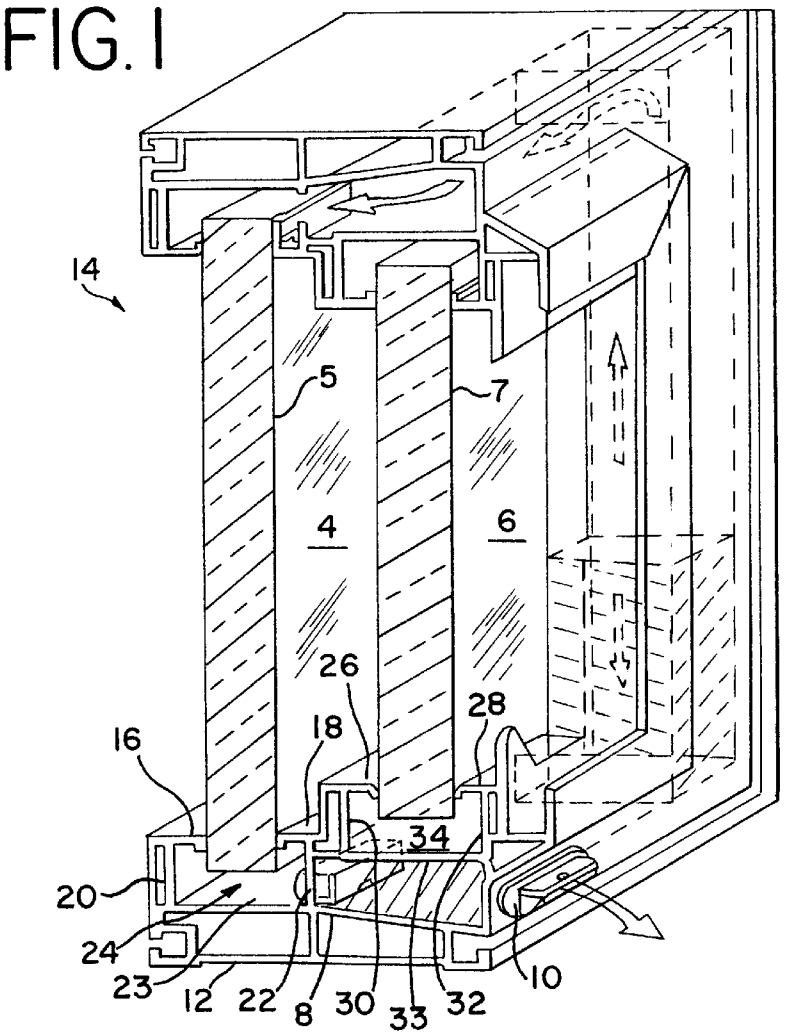
FIG. 1 is a partially cut-away front perspective view of a window unit of the invention.
Figure 3:
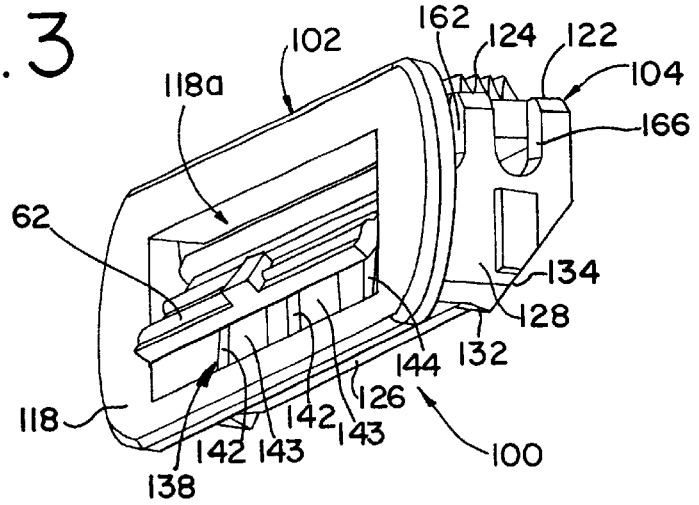
FIG. 3 is a front perspective view of an external weeper of the invention.
Figure 4:
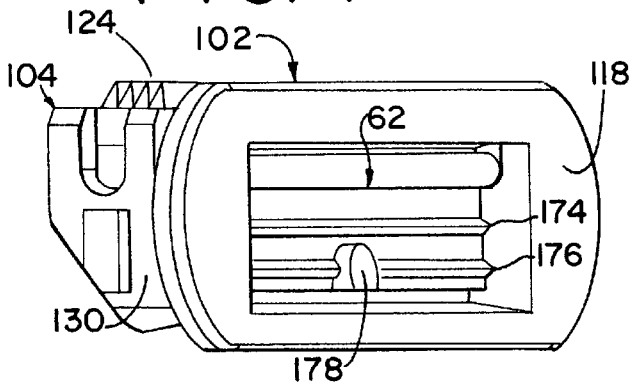
FIG. 4 is a perspective view of the weeper in FIG. 3 showing the weeper in a closed position.
Figure 5:
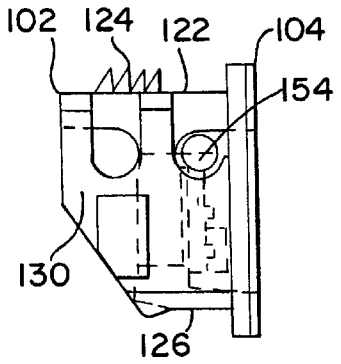
FIG. 5 is a side elevation view of the weeper in FIG. 3 showing the weeper in a closed position.
Figure 6:
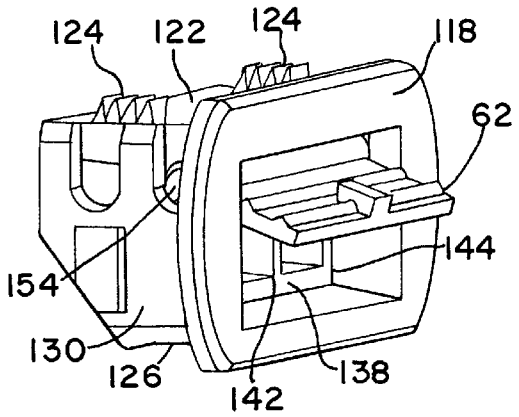
FIG. 6 is a front perspective view of the weeper in FIG. 3 showing the weeper in an open position.
Figure 7:
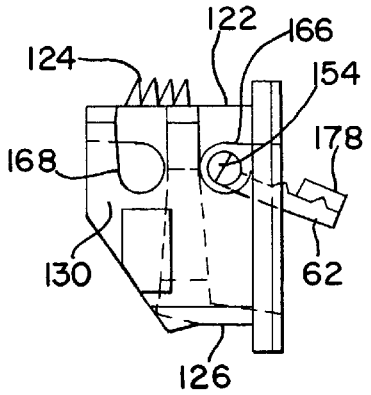
FIG. 7 is a side elevation view of the weeper in FIG. 3 showing the weeper in an open position.
Figure 8:
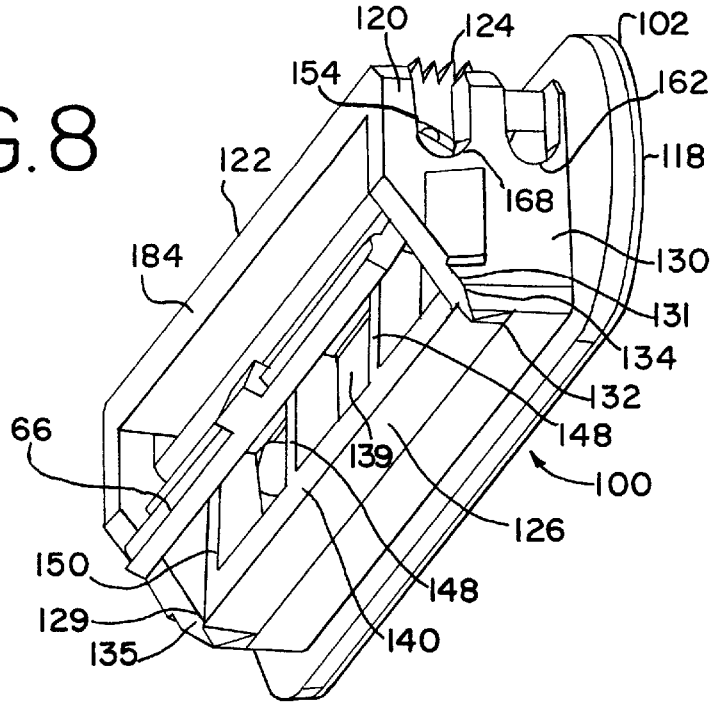
FIG. 8 is a perspective view of an internal weeper of the invention.
Figure 9:
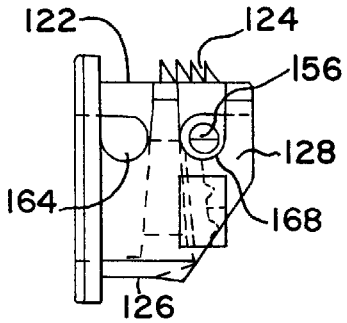
FIG. 9 is a side elevation view of the weeper in FIG. 8 showing the weeper in a closed position.
Figure 10:
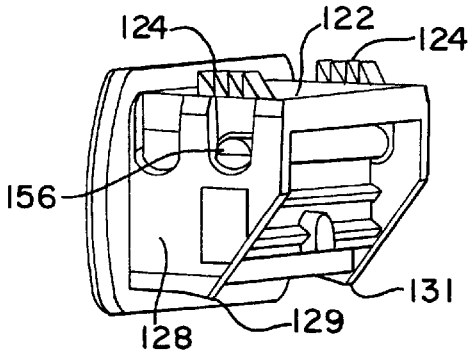
FIG. 10 is a perspective view of a weeper in FIG. 8 showing the weeper in a closed position.
Figure 11:
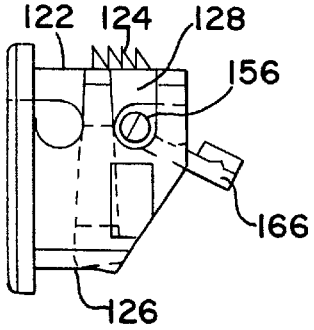
FIG. 11 is a side elevation view of a weeper in FIG. 8 showing the weeper in an open position.
Figure 12:
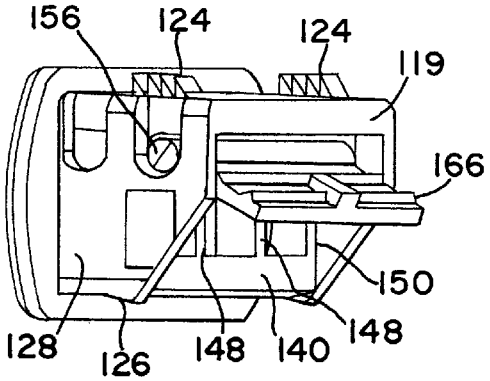
FIG. 12 is a perspective view of the weeper in FIG. 8 showing the weeper in an open position.

FIG. 1 shows internal and external weepers or drain units 8 and 10 installed in a frame 12 of a window unit 14. Frame 12 is formed by extrusion or other conventional means known in the art. The frame 12 is designed for mounting of inner 4 and outer panels 6, each of such panels comprising one or more glass panes mounted in a sash. In one embodiment, the inner panel is a sliding panel and the second panel is a fixed panel. Frame 12 is provided with a pair of sill flanges 16 and 18 for mounting of the inner panel by snap-fit engagement with stepped contours provided in the sash 5 of the inner panel 4. Flanges 16 and 18 extend from sidewalls 20 and 22 respectively and are joined by floor 23 to form a first channel 24 disposed and extending peripherally about the perimeter of the first panel. Sash 12 is further provided with sill flanges 26 and 28 for mounting of the outer panel 6 by snap-fit engagement with stepped contours provided in the sash 7 of the outer panel 6. Flanges 26 and 28 extend from sidewalls 30 and 32 respectively and are joined by floor 33 to form a second channel 34 disposed and extending peripherally about the perimeter of second panel.

Figure 2:
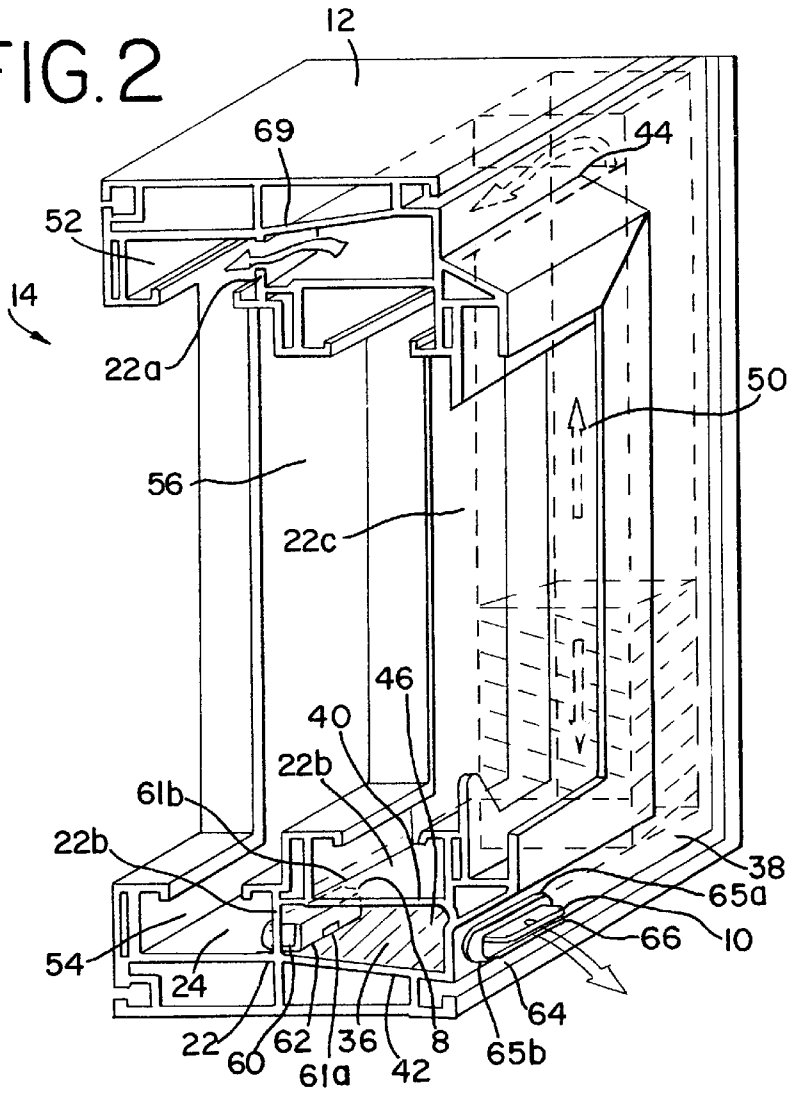
FIG. 2 is a similar to FIG. 1 with the window being removed from the window frame.

Referring to FIG. 2, a cavity 36 is also formed within frame 12 during the manufacturing process. Cavity 36 shares sidewall 22 with first channel 24, which functions as an inner sidewall, and further includes outer sidewall 38. In this respect, cavity 36 is disposed outwardly of first channel 24. Upper and lower ends of sidewalls 22 and 38 are joined by a horizontally extending member 40 and downwardly sloping floor 42. In one embodiment, and as illustrated in FIG. 1, horizontally extending member 40 of third channel 36 is also floor 33 of second channel 34.

First channel 24 includes upper and lower horizontally extending sections 52 and 54 joined by first and second vertically extending sections 56 and 58 (only one is shown). In this respect, first channel 24 extends about the perimeter of the inner panel. Cavity 36 also includes upper and lower horizontally extending sections 44 and 46 joined by first and second vertically extending section 48 and 50 (only one is shown). In this respect, sections 44, 46, 48, and 50 of cavity 36 are separated from sections 52, 54, 56, and 58 of first channel 24 by sidewall 22 which includes upper and lower horizontally extending sections 22*a* and 22*b* joined by first and second vertically extending sections 22*c* and 22*d* (only one is shown).

A throughbore 60 is formed within sidewall section 22*b* to facilitate direct communication and connection between lower section 46 of cavity 36 and lower section 54 of first channel 24. Throughbore 60 is provided to facilitate drainage of collected moisture in first channel 24 into cavity 36. Internal weeper 8 is installed in throughbore 60 to control such drainage and, in this respect, includes a flapper valve 62. Flapper valve 62 is characterized by open and closed positions. Flapper valve 62 is urged into the open position by fluid pressure in first channel 24. Without such fluid pressure, flapper valve 62 remains closed to seal cavity 36 from first channel 24. Throughbore 64 is formed in sidewall 38 to facilitate drainage of moisture collected in cavity 36 into the exterior or outside environment. External weeper 10 is installed in throughbore 64 to control such drainage and, in this respect, includes a flapper valve 66. Flapper valve 66 is characterized by open and closed positions. Flapper valve 66 is urged into the open and closed position by fluid pressure in cavity 36. Without such fluid pressure, flapper valve 66 remains closed to seal cavity 36 from the external environment. Second channel 34 is formed with its own throughbore and installed with a separate weeper (not shown) to facilitate controlled drainage of second channel 34 directly into the environment.

First channel 24 also communicates with cavity 36 via slot or throughbore 69 formed in sidewall 22*a*. Throughbore 69 is disposed at a level above throughbore 60. In one embodiment throughbore 69 is formed with upper sidewall section 22*a*. Throughbore 69 effects permanent communication between first channel 24 and cavity 36. As such, pressure is substantially equalized between first channel 24 and cavity 36.

During high wind conditions, particularly during storms, it is possible that outside air pressure, external to window unit 14, is higher than the internal air pressure due to conversion of wind velocity head to static pressure. Under these conditions, a relative vacuum is created within the frame whereby water could be sucked into first channel 24. Simultaneously, the created relative vacuum could also pull the internal and external weepers 8 and 10 into a closed position, thereby preventing escape of collected moisture from within channel 24 and cavity 36. By providing upper throughbore 69, pressure within cavity 36 is substantially equalized with the internal air pressure in channel 24. Because of this, the head of water collected in channel 24 is able to push open flapper valve 62 and allow the water to drain into cavity 36. Water, therefore, collects in cavity 36 and the head of water eventually forces open flapper valve 66 when sufficient elevation head is developed in cavity 36 to overcome outside air pressure or when the wind velocity and resulting velocity head decreases thereby urging flapper valve 66 into a closed position.

With reference now to FIGS. 3 through 13, in one embodiment, drain unit 100 can be provided to serve as either the internal weeper 8 or external weeper 10 of a window unit 14. Referring to FIGS. 3 to 12, drain unit 100 has a first end 102 and a second end 104. Flange 118 is provided at first end 102 including a first drain opening 118*a*. First end 102 is joined to second end 104 by, and is formed integral with, rectangular frame 120. Frame 120 includes an upper wall 122, a lower wall 126, and opposing side walls 128 and 130. Upper and lower walls 122 and 126 extend between and join sidewalls 128 and 130. Upper wall 122 of frame 120 has a plurality of longitudinal, equispaced, upstanding V-shaped ribs 124 at each end and lower wall 126 preferably has a plurality of longitudinal pliable ribs 132 projecting rearwardly from convex rear edges 134 and 135 of sidewalls 128 and 130. Each of sidewalls 128 and 130 terminate at respective distal ends 129 and 131 to merge with and define an open second end 104. The distal ends 129 and 131 bevelled rearwardly upwardly at about 45° from lower edges 134 and 135 to merge with upper wall 122. Frame 120 also extends into flange 118 along each of the upper and lower walls 122 and 126 and side walls 128 and 130.

Frame 120 includes a first seating surface 138 and a second seating surface 140. First seating surface 138 extends between upper and lower walls 122 and 126, and sidewalls 128 and 130, and further lies in a plane substantially perpendicular to the longitudinal axes of the upper and lower walls 122 and 126. First seating surface 138 is further disposed rearwardly of flange 118 and is recessed within opening 118*a*. First seating surface 138 includes a plurality of substantially equispaced ribs 142 extending between upper and lower walls 122 and 126 with gaps orifices 143 therebetween. Equispaced ribs 142 include terminal ribs 144 extending from each of sidewalls 128 and 130. Together, ribs 142 and 144 and upper and lower walls 122 and 126 define first seating surface 138 for providing a planar open seat for flapper valve 6.

Second seating surface 140 also extends between upper and lower walls 122 and 126 and sidewalls 128 and 130, and further lies in a plane substantially perpendicular to the longitudinal axis of upper and lower walls 122 and 126. Second seating face 140 is interposed between first seating surface 138 and second end 104 and is, therefore, recessed into frame 120 relative to second end 102. In greater detail, seating surface includes a plurality of substantially equispaced ribs 148 extending between upper and lower walls 122 and 126 with gaps or orifices 149 therebetween. Equispaced ribs 148 include terminal ribs 150 extending from each of sidewalls 128 and 130. Together, ribs 148 and 150 and upper and lower walls 122 and 126, define second seating surface 140 for providing a planar open seat for flapper value 62.

First end 102 communicates with second end 104 to provide a flowpath through drain unit 100. In this respect, opening 18*a* opens into second end via communication with gaps 143 and 149.

Drain 100 can be provided to serve either as external weep 10, to facilitate escape of moisture collected in cavity 36 or can be provided to serve as internal weep 8, to drain first channel 124.

Referring to FIGS. 3 to 12, rectangular flapper valves 62 or 66 are pivotally mounted in frame 120 between first and second ends 102 and 104. In this respect, cylindrical lug extensions 154 and 156 are provided projecting laterally from respective rounded upper edges of each of flapper valves 62 or 66. Lug extensions 154 and 156 project into and can be received by respective round mating holes 162, 164 and 166, 168 formed in the opposed sidewalls 128 and 130.

In one embodiment, either of rectangular flapper valves 62 and 66 is mounted to lie in a plane characterized by an angular position of 4° from the vertical plane or, in other words, a plane which is substantially normal to the longitudinal axis of opening 118*a*. This feature improves sealing of flapper valves 62 or 66 against its associated seating surface. Further, less water pressure is required to effect opening of flapper valves 62 or 66.

Each of flapper valve 62 and 66 is slightly shorter in width than the width of respective seating surfaces 138 and 140 in frame 120 and is centered therein by small guide protrusion at each side edge thereof to ensure free pivotal movement of flapper valve 62 and 66.

Upper and lower stiffening flanges 174 and 176 are provided at the bottom front face of each of flapper valves 62 and 66. Lower stiffening flange 176 has a central protrusion 178 forming part thereof or adjacent thereto adapted to abut against the upper edge of openings to limit the upward movement of respective flapper valves 62 or 66.

Installation of drain unit 100 in throughbore 60 to act as internal weeper 8 will be explained with reference to FIGS. 1, 2 and 8 to 12. Flange 118 is pressed against internal surface 23 of sidewall section 22*b* to seal drain unit 100 against sidewall section 22*b*. Upper ribs 124 ensure a frictional locking engagement with the throughbore 60, the upper edge 61*a* of through 60 preferably fitting between upper wall 122 and foremost of the ribs 124. Lower pliable ribs 132 are biased against the lower edge 61*b* of throughbore 60 to provide a water deflector and a seal while urging the frame 120 upwardly against upper edge 61*a* for secure engagement therewith. Flapper valve 62 is installed within mating holes 166 and 168 to facilitate drainage of first channel 24 into cavity 36, thereby functioning as a one-way check valve.

Installation of drain unit 100 in throughbore 64 to act as external weeper 10 will be explained with reference to FIGS. 1 to 7. Flange 118 is pressed against outer surface of outer sidewall 38 to seal drain unit 100 against sidewall 38. Upper ribs 124 ensure a friction locking engagement with throughbore 64, the upper edge 65*a* of throughbore 64 preferably fitting between upper wall 122 and foremost of the ribs 124. Lower pliable ribs 132 are biased against the lower edge 65*b* of throughbore 64 to provide a water deflector and a seal while urging frame 120 upwardly against upper edge 65*a* for secure engagement therewith. Flapper valve 66 is installed within mating holes 162 and 164 to facilitate drainage of cavity 36 into the outside environment, thereby functioning as a one-way check valve.

It will be understood, of course that modifications can be made in the embodiment of the invention illustrated and described herein without departing from the scope and purview of the invention as defined by the appended claims.

I claim:

1. A window unit including an extruded frame and a moveable window panel, the frame comprising:

a channel for mounting the window panel therein;

a cavity disposed outwardly of the channel;

first and second throughbores for facilitating communication between the channel and the cavity, wherein the first throughbore is disposed at a level below the second throughbore;

a third throughbore for facilitating communication between the cavity and an external environment; and a first weeper, mounted in the first throughbore, including a flapper valve characterized by open and closed positions, wherein the flapper valve assumes the open position upon urging by fluid pressure in the channel.

2. The window unit as claimed in claim 1 further comprising a second weeper, mounted in the third throughbore, including a flapper valve characterized by open and closed positions, wherein the flapper valve assumes the open position upon urging by fluid pressure in the cavity.

3. A water drain unit for insertion in a mating wall slot in a window unit, comprising:

a frame;

a first and a second set of mating holes formed in the frame;

a first seating surface including a first orifice, and a second seating surface including a second orifice, wherein the first and second seating surfaces are mounted in the frame and wherein the first and second orifices are in communication; and a flapper valve mounted within either of the first or second set of mating holes for seating against the first seating surface when mounted in the first set of mating holes and for seating against the second seating surface when mounted in the second set of mating holes.

4. A water drain unit as claimed in claim 3 wherein the frame further comprises:

a peripheral flange disposed at a first end of the frame for abutment against the wall of a window unit, and defining a drain opening;

a deep upper wall with a plurality of upstanding ribs extending therefrom for frictional engagement with the wall slot;

a shallow lower wall with a plurality of pliable ribs depending therefrom for frictional engagement with the wall slot; and first and second sidewalls extending between and joining the upper and lower walls, each of the sidewalls terminating and merging with a second end of the frame to define a second open end, wherein the first and second mating holes are formed in the first and second sidewalls;

whereby the first and second orifices facilitate communication between the drain opening and the second open end.

5. The window unit of claim 1 wherein the weeper further comprises:

a weeper frame defining a draining passage;

a first seating surface integrally formed in the frame;

a second seating surface integrally formed in the frame;

the flapper valve pivotally mountable in the frame to seat against either the first seating surface or the second seating surface when the flapper valve is in its closed position.

6. A window unit including an extruded frame and a moveable window panel, the frame comprising:

a channel for mounting the window panel therein;

a cavity disposed outwardly of the channel;

first and second throughbores for facilitating communication between the channel and the cavity, wherein the first throughbore is disposed at a level below the second throughbore;

a third throughbore for facilitating communication between the cavity and an external environment;

a first weeper, mounted in th first throughbore, including a flapper valve characterized by open and closed positions, wherein the flapper valve assumes the open position upon urging by fluid pressure in the channel; and a second weeper mounted in the third throughbore, including a flapper valve characterized by open and closed positions, wherein the flapper valve assumes the open position upon urging by fluid pressure in the cavity.

7. A drain unit for insertion into a mating wall opening in a hollow window or door frame, the unit comprising:

a frame having a first end and a second end and a drain passage throughbore, the frame defining a first seating surface proximate the first end and a second seating surface proximate the second end; and a flapper pivotally mountable in the frame to seat against one of either the first seating surface and the second seating surface.

8. The drain unit of claim 7 wherein the frame further comprises:

a first set of holes proximate the first end;

a second set of holes proximate the second end;

wherein the flapper is pivotally received in one of either the first set of holes to seat against the first seating surface and the second set of holes to seat against the second seating surface.

9. The drain unit of claim 8 wherein the flapper is pivotable towards the first end when mounted in the first set of holes and wherein the flapper is pivotable towards the second end when mounted in the second set of holes.

10. The weeper device of claim 7 wherein the frame has a flange proximate the first end.

11. A drain unit for insertion into a mating wall opening in a hollow window or door frame, the unit comprising:

a frame having a first end and a second end and a drain passage throughbore, the frame defining a first seating surface proximate the first end, the first seating surface having a first orifice in communication with the passage, the frame further defining a second seating surface proximate the second end, the second seating surface having a second orifice in communication with the passage, the frame further having a first set of holes proximate the first end and a second set of holes proximate the second end; and a flapper pivotally mountable in one of either the first set of holes to seat against the first seating surface and the second set of holes to seat against the second seating surface.

12. A drain unit for insertion into a mating wall opening in a hollow window or door frame, the unit comprising:

a frame having an upper wall, lower wall and a pair of sidewalls extending between and joining the upper and lower walls, frame having a first end and a second end wherein the walls define a drain passage through the frame, the frame defining a first seating surface proximate the first end and a second seating surface proximate the second end, the first seating surface having a first orifice in communication with the drain passage and the second seating surface having a second orifice in communication with the drain passage, each sidewall having a first hole proximate the first end and a second hole proximate the second end; and a flapper having a pair of opposed outwardly extending extensions, the extensions being received by one of the respective first holes of the sidewalls and the respective secondholes of the sidewalls, wherein when the extensions are received by the first holes, the flapper seats against the first seating surface and is pivotable towards the first end, and wherein when the extensions are received by the second holes, the flapper seats against the second seating surface and is pivotable towards the second end.

* * * * *

UNITED STATES PATENT AND TRADEMARK OFFICE

CERTIFICATE OF CORRECTION

PATENT NO. : 6,374,557 B1
DATED : April 23, 2002
INVENTOR(S) : Richard H. O'Donnell It is certified that error appears in the above-identified patent and that said Letters Patent is hereby corrected as shown below:

Column 4,
Line 59, delete "Second seating face 140" and insert therefore -- Second seating surface 140 --

Column 5,
Line 2, delete "flapper value 62." and insert therefore -- flapper valve 62. --
Line 45, delete "through" and insert therefore -- throughbore --

Column 7,
Line 16, delete "th" and insert therefore -- the --

Signed and Sealed this

Third Day of September, 2002

*Attest:*

*Attesting Officer*

JAMES E. ROGAN
*Director of the United States Patent and Trademark Office*